US006510296B2

(12) United States Patent
Less et al.

(10) Patent No.: US 6,510,296 B2
(45) Date of Patent: Jan. 21, 2003

(54) XEROGRAPHIC PRINTING APPARATUS, VARYING BIAS DURING THE TRANSFER STEP

(75) Inventors: Krzysztof J. Less, London (GB); Ian Pitts, Cambs (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/066,142

(22) Filed: Feb. 1, 2002

(65) Prior Publication Data

US 2002/0076228 A1 Jun. 20, 2002

Related U.S. Application Data

(63) Continuation-in-part of application No. 09/736,740, filed on Dec. 14, 2000, now Pat. No. 6,345,168.

(51) Int. Cl.[7] ..... G03G 15/16
(52) U.S. Cl. ..... 399/66; 399/314
(58) Field of Search ..... 399/66, 314, 313

(56) References Cited

U.S. PATENT DOCUMENTS

| | | | | |
|---|---|---|---|---|
| 4,190,348 A | | 2/1980 | Friday | 355/3 TR |
| 5,083,167 A | | 1/1992 | Fukushima et al. | 355/274 |
| 5,287,163 A | | 2/1994 | Miyashiro et al. | 355/326 R |
| 5,298,954 A | * | 3/1994 | Fujita et al. | 399/313 |
| 5,410,393 A | | 4/1995 | Watanabe | 355/273 |
| 5,541,718 A | | 7/1996 | Oono | 355/271 |
| 5,598,256 A | | 1/1997 | Kimura et al. | 399/316 |
| 6,009,286 A | | 12/1999 | Watanabe et al. | 399/44 |

FOREIGN PATENT DOCUMENTS

| | | |
|---|---|---|
| JP | 56-150777 | * 11/1981 |
| JP | 2-167584 | * 6/1990 |
| JP | 10-39639 | * 2/1998 |

* cited by examiner

*Primary Examiner*—Quana M. Grainger
(74) *Attorney, Agent, or Firm*—R. Hutter

(57) ABSTRACT

In a xerographic printing apparatus, during the transfer step wherein marking material is electrostatically transferred from the photoreceptor to the print sheet by a transfer corotron and the sheet is then detached from the photoreceptor by a detack corotron, the bias associated with the transfer corotron is maintained at a constant value while the bias associated with the detack corotron is progressively decreased to approximately zero as the print sheet moves through the transfer zone.

8 Claims, 1 Drawing Sheet

XEROGRAPHIC PRINTING APPARATUS, VARYING BIAS DURING THE TRANSFER STEP

CONTINUATION IN PART APPLICATION

The present application is a continuation-in-part of U.S. patent application Ser. No. 09/736,740, filed Dec. 14, 2000, now U.S. Pat. No. 6,345,168, and allowed but not issued as of the filing hereof.

FIELD OF THE INVENTION

The present invention relates to the transfer step in electrostatographic printing, such as xerography, wherein marking material is electrostatically transferred from a charge receptor onto a print sheet.

1. Background of the Invention

The basic process steps of electrostatographic printing, such as xerography or ionography, are well known. Typically an electrostatic latent image is created on a charge receptor, which in a typical analog copier or "laser printer" is known as a photoreceptor. The suitably charged areas on the photoreceptor surface are developed with fine toner particles, creating an image with the toner which is transferred to a print sheet, which is typically a sheet of paper but which could conceivably be any kind of substrate. This transfer is typically carried out by the creation of a "transfer-detack zone" (often abbreviated to just "transfer zone") of AC and DC biases where the print sheet is in contact with, or otherwise proximate to, the photoreceptor.

A DC bias applied to the back (i.e. on the face away from the photoreceptor) of the paper or other substrate in the transfer zone by means of the transfer device, (corotron, transfer roll etc.) electrostatically transfers the toner from the photoreceptor to the paper or other substrate presented to the transfer zone. This action however, causes electrical charge to be deposited onto back of the substrate. This "transfer charge" on the back of the substrate causes an electrostatic attraction between the substrate and the photoreceptor, making it difficult to remove the substrate from the photoreceptor. To overcome this problem, the transfer charge is fully or partially neutralized by subsequently subjecting the back of the substrate to a combination of AC charge with a DC bias by the use of a detack corotron.

It has been found, particularly in the design of compact copiers and printers, that the quality of image transfer can vary between a lead edge of a print sheet (i.e., the first edge of the sheet that approaches the photoreceptor) and the trail edge (i.e., the last portion of the sheet to be close to the photoreceptor). Depending on a specific design, there may be any number of reasons for this. For instance, when relatively heavy papers are used, the trail edge of each sheet may not be in the same tight contact with the photoreceptor as the lead edge had been. Also, in a small machine, the trail edge of the sheet may still be in the transfer zone while most of the sheet is in or past the fuser, and mechanical disturbances from the fuser may travel through the print sheet during the last part of the transfer step.

The present invention relates to a method of controlling the transfer—detack step, to obviate the above-mentioned practical difficulties.

2. Description of the Prior Art

U.S. Pat. No. 4,190,348 discloses a xerographic transfer system in which a non-uniform increase in transfer charge is applied to the lead edge of each copy to improve the effective image transfer.

U.S. Pat. No. 5,083,167 discloses a transfer device which supplies a different electric charge amount per area to an end of the transfer material relative to the rest of the transfer material. FIGS. 7 and 9 show how charge is ramped up immediately before a sheet is transferred, and ramped down immediately thereafter.

U.S. Pat. No. 5,287,163 discloses a transfer system in which the transfer bias is progressively increased, in absolute terms, between a leading and trailing edge of a sheet having an image transferred thereto.

U.S. Pat. No. 5,410,393 discloses, at FIG. 4 thereof, a transfer system in which the bias is briefly set to a first polarity just before transfer of a sheet, and then set to the opposite polarity for the duration of the transfer step.

U.S. Pat. No. 5,541,718 discloses a transfer system in which the transfer bias is altered depending on whether a sheet is being guided by one or another guide member adjacent to the transfer zone.

U.S. Pat. No. 5,598,256 discloses, at FIG. 2 thereof, a transfer system in which the strength of the transfer field is momentarily spiked between feeding the leading edge of a sheet, and transferring the leading edge of an image to be placed on the sheet.

U.S. Pat. No. 6,009,286 discloses a transfer device in which a relatively high transfer field is provided at both the leading edge and trailing edge of a sheet being transferred.

SUMMARY OF THE INVENTION

According to the present invention, there is provided a method of transferring marking material from a charge receptor to a print sheet in an electrostatographic printing apparatus. The print sheet is moved relative to the charge receptor in a process direction through a transfer zone whereby the print sheet presents to the charge receptor a lead edge and a trail edge. The transfer zone includes a transfer device and a detack device. During the moving step, a bias associated with the detack device is decreased from an initial high absolute value to approximately zero.

DETAILED DESCRIPTION

Figure 1:
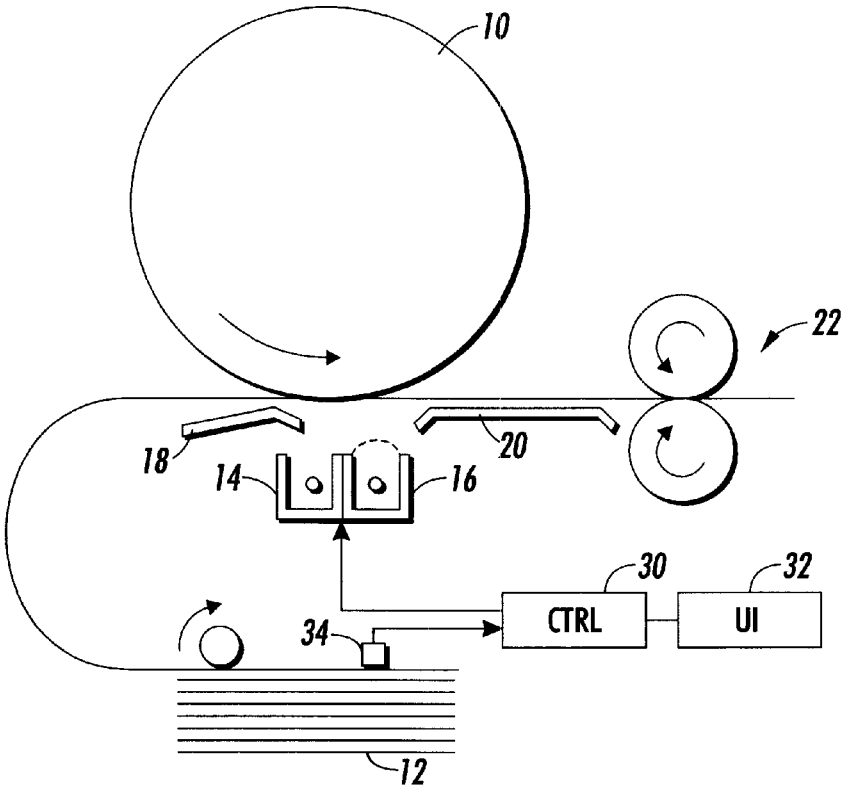
FIG. 1 is a simplified elevational diagram showing the essential elements of an electrostatographic printing apparatus, such as a printer or copier, relevant to the present invention.

FIG. 1 is a simplified elevational diagram showing the essential elements of an electrostatographic printing apparatus, such as a printer or copier, relevant to the present invention. As is familiar in electrostatographic printing, in particular ionography or xerography, electrostatic latent images are created on the surface of a charge receptor, such as the photoreceptor indicated as 10. (The ancillary elements typically associated with such a printer, such as a charge corotron, exposure device, development unit, and so forth, are not shown but would be apparent to one of skill in the art. Also, consistent with the claims hereinbelow, a charge receptor can be an intermediate member, such as a belt, on which successive toner images are accumulated before final transfer, such as in color xerography.) The sheets on which images are desired to be printed are drawn from a stack 12 and brought into what can generally be called a "transfer zone" which, depending on a particular design of apparatus, typically involves contact of the sheet with the surface of the photoreceptor. As the term is used herein, the transfer zone is the location in which the sheet is presented to the charge receptor to receive marking material therefrom, and then detached from the charge receptor, such as to be directed to a fusing apparatus. When a sheet is passed through the transfer zone through a process direction, first a lead edge and then finally a trail edge of the sheet will be presented to the charge receptor.

In the particular illustrated embodiment, there is provided, in the transfer zone, two charge emitting devices, a transfer corotron 14, and a detack corotron 16. The basic design of such corotrons are well known in the art; the essential function of each corotron is to emit charge of a certain magnitude and polarity into at least a portion of the transfer zone. More specifically, transfer corotron 14 is intended to have the main function of electrostatically dislodging the marking material on the surface of photoreceptor 10 so that it instead adheres to the sheet, while the function of detack corotron 16 is to use electrostatic forces to detach the sheet from the surface of photoreceptor 10. As illustrated and as will be described below, each corotron 14, 16 includes at least one wire, or coronode, which functions to generate electric fields, although other types of charging devices, such as including an array of pins, a screen, or a roll, are known in the art and can be employed pursuant to the invention.

Typically, there is provided adjacent to the transfer zone various paper guides to ensure suitable interaction between a sheet and the photoreceptor. Typical of such guides include a "halo guide" 18, which typically extends over the effective area of a transfer corotron such as 14, and a paper path guide such as 20, which guides a sheet from the transfer zone toward the nip of a fusing apparatus such as generally indicated by 22.

With certain specific designs of electrostatographic printing apparatus, the behavior of the deliberately-induced electrical fields in a transfer zone, such as created by transfer corotron 14, detack corotron 16, or their equivalents in different devices, has a profound effect on print quality, particularly within a single printed sheet. In brief, the electrostatic conditions which are optimal for transfer of marking material at a leading edge of a sheet being fed through the transfer zone may be significantly different from the optimal electrostatic conditions for the middle of the sheet, or for the trailing edge of the sheet. As mentioned above, there may be several reasons for this: first, a leading edge of a sheet may require a greater electrical force for detachment from the photoreceptor than the middle of a sheet, and, particularly in smaller machines, the trailing edge of a sheet will still be in the transfer zone even as much of the sheet is already entered into the fuser. The present invention is directed toward controlling the electrical fields in the transfer zone relative to different portions of a sheet being fed therethrough.

The necessary electrical fields for image transfer and detack are provided by associating with the transfer corotron 14 and the detack corotron 16 various biases. Typically, there is applied to the transfer corotron a DC current only, and to the detack corotron an alternating current with a DC bias. As used herein, the term "bias" shall refer to either a voltage bias or a current bias as applied to a corotron, causing the corotron to create a field within at least a portion of the transfer zone. According to one embodiment of the present invention, during the time in which a single sheet is passed, starting with a lead edge and moving to a trail edge thereof, through the transfer zone, a bias (voltage and/or current) applied to the detack corotron 16 is started at an initial relatively high absolute value (i.e., disregarding, for present purposes, the polarity of the bias) and decreased to approximately zero.

Simultaneously, during the transfer step, the bias applied to the transfer corotron 14 is kept at a substantially constant value. In one specific implementation, the total DC current supplied to the transfer wire within corotron 14 is kept constant. The actual voltage on the corotron may vary for different paper types and altitudes, etc., and according to the functions of a power control associated therewith, but the transfer current will be kept constant.

Figure 2:
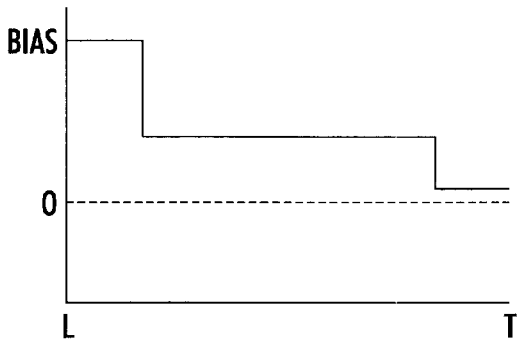
FIG. 2 is a graph showing the behavior of a bias in a transfer zone such as shown in FIG. 1, according to an embodiment of the present invention.

FIG. 2 is a diagram of a bias associated with the detack corotron 16, as a print sheet moves through the transfer zone starting with its lead edge L toward its trail edge T. As shown, for approximately the first inch (i.e., from 1 to 4 centimeters) in this embodiment, the bias of detack corotron 16 is at a high absolute value, and then is decreased, in a discrete step, to a medium absolute value. Finally, for approximately the last inch before the trail edge (i.e., from 1 to 4 centimeters), the bias is decreased to approximately zero.

The varying of the bias in the transfer zone will of course be ultimately controlled by a control system within the printing apparatus, and this control system is generally shown in FIG. 1 as 30. The control system 30 can independently operate either the transfer corotron 14 or the detack corotron 16 to obtain the desired electrical properties within the transfer zone during the transfer process. In one specific practical implementation, the offset applied to the detack corotron 16 via the control system 30 is a current offset. The value set in the control system specifies the net DC current flowing from the corotron wires, and this is the algebraic sum of the negative and positive currents within the corotron 16. If the magnitude of the negative current is greater than the magnitude of the positive current, then the net current will be negative, and vice-versa.

The control system 30 generates the DC offset current by applying an offset voltage to the wire within corotron 16. A circuit in the power supply to the corotron 16 monitors the net DC current flowing to the wire. If the current is too negative the system will make the offset voltage less negative (i.e. more positive), in order to make the offset current less negative, etc. The DC offset voltage will vary with time and conditions in order to keep the DC offset current constant at the programmed value over the course of the printing step. Thus the voltage potential on the surface of the print sheet as it passes over the detack corotron 16 will not affect the net DC current supplied to the corotron, but will affect the offset voltage applied to the corotron.

For present purposes, the "approximately zero" quality of the bias toward the trail edge shall be defined as at least one of current and voltage being less than ten percent of the current and voltage associated with the initial high absolute value at the lead edge. As will be appreciated, in a practical embodiment of the invention, such as including various feedback mechanisms associated with a power supply, specific values of current and voltage during the course of operation will depend on various factors; in essence, a certain voltage value may be applied by a control system to the detack corotron 16 in order to achieve a desired current, or vice-versa. This principle should be taken into account in interpreting the claims.

As further can be seen in the Figure, the control system 30 can be ultimately accessed via a user interface (UI) indicated as 32. According to a preferred embodiment of the present invention, a particular behavior of the DC bias in the transfer zone may be most useful only for a particular type of sheet, most importantly for a particular weight of sheet. In other words, in a particular design of an electrostatographic printing apparatus, relatively heavy weight papers may not require the variation of the DC bias for detacking purposes, while lighter papers may benefit from the variation of the DC bias. In a sophisticated embodiment, specific weights and types of paper being fed through the machine can be mapped to very specific behaviors of the DC bias. The entry of a specific sheet weight at a particular time, in a way which would influence the control system 30 to provide a particular DC bias behavior during transfer, can be provided through user interface: that is, at one point a user can enter the weights of different stocks in different paper supplies, and when a sheet is fed from a particular paper supply of the weight thereof would be noted. During printing, the determined weight of the sheet is mapped to, for instance, a suitable initial bias for optimized performance. Alternately there could be provided some sort of sensor, such as 34, which would be capable of determining the type or other quality of the paper at a particular stack 12, and then relay this information to the control system 30. This principle affecting the behavior of the DC bias during transfer can be applied not only to the weight of the paper, but to other qualities of sheets as well, such as whether the sheets are coated paper or transparencies.

Another consideration which can influence a choice of biases is whether there is being transferred a second side image onto a print sheet which has already received a first-side image thereon, such as in a printer with duplex capability. Another consideration which can influence a choice of biases is the altitude, relative to sea level, of the particular machine: typically a "high-altitude mode" can be entered during setup of the machine as needed.

A sensor such as 34, or some equivalent means, is also useful in conjunction with the present invention for the purpose of determining the size of a type of sheet in a particular stack, for instance whether the sheets in a particular stack are letter size, A4, A3, or whatever. Clearly, the specific size of a sheet being fed through the apparatus will determine the precise timing of the changes in bias such: with a sheet which is smaller in the process direction between its lead edge L and its trail edge T, the steps will of course be of relatively shorter duration, assuming a constant velocity for all sheet sizes. This coordination of the timing of the bias changes during the transfer process with the determined size of a particular sheet being printed upon can be carried out within control system 30, based on input from either a user interface 32 or one or more sensors such as 34.

What is claimed is:

1. A method of transferring marking material from a charge receptor to a print sheet in a transfer zone of an electrostatographic printing apparatus, the transfer zone including a transfer device and a detack device, comprising the steps of:

moving the print sheet relative to the charge receptor in a process direction through the transfer zone, whereby the print sheet presents to the charge receptor a lead edge and a trail edge;

during the moving step, decreasing a bias associated with the detack device from an initial high absolute value to approximately zero; and during the moving step, maintaining a bias associated with the transfer device at a substantially constant value.

2. A method of transferring marking material from a charge receptor to a print sheet in a transfer zone of an electrostatographic printing apparatus, the transfer zone including a transfer device and a detack device, comprising:

moving the print sheet relative to the charge receptor in a process direction through the transfer zone, whereby the print sheet presents to the charge receptor a lead edge and a trail edge;

during the moving step, decreasing a bias associated with the detack device from an initial high absolute value to approximately zero; and wherein the decreasing step includes decreasing the bias from the initial high absolute value to a medium absolute value at about one inch from the lead edge.

3. A method of transferring marking material from a charge receptor to a print sheet in a transfer zone of an electrostatographic printing apparatus, the transfer zone including a transfer device and a detack device, comprising:

moving the print sheet relative to the charge receptor in a process direction through the transfer zone, whereby the print sheet presents to the charge receptor a lead edge and a trail edge;

during the moving step, decreasing a bias associated with the detack device from an initial high absolute value to approximately zero; and wherein the decreasing step includes decreasing the bias from the medium absolute value to approximately zero at about one inch from the trail edge.

4. A method of transferring marking material from a charge receptor to a print sheet in a transfer zone of an electrostatographic printing apparatus, the transfer zone including a transfer device and a detack device, comprising:

moving the print sheet relative to the charge receptor in a process direction through the transfer zone, whereby the print sheet presents to the charge receptor a lead edge and a trail edge;

during the moving step, decreasing a bias associated with the detack device from an initial high absolute value to approximately zero; and wherein approximately zero is defined as at least one of current and voltage being less than ten percent of the current and voltage associated with the initial high absolute value.

5. The method of claim 4, further comprising during the moving step, maintaining a bias associated with the transfer device at a substantially constant value.

6. The method of claim 4, wherein the decreasing step includes decreasing the bias in at least one discrete step.

7. The method of claim 4, wherein the decreasing step includes decreasing the bias from the initial high absolute value to a medium absolute value at about one inch from the lead edge.

8. The method of claim 4, wherein the decreasing step includes decreasing the bias from the medium absolute value to approximately zero at about one inch from the trail edge.

* * * * *